US006354697B1

(12) United States Patent
Tanaka et al.

(10) Patent No.: US 6,354,697 B1
(45) Date of Patent: Mar. 12, 2002

(54) ELECTROSTATIC TYPEINKJET HEAD HAVING A VENT PASSAGE AND A MANUFACTURING METHOD THEREOF

(75) Inventors: Makoto Tanaka; Eiichi Ohta, both of Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/346,056

(22) Filed: Jun. 29, 1999

(30) Foreign Application Priority Data

Jun. 30, 1998 (JP) ..... 10-184551

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS 5,513,431 A 5/1996 Ohno et al.
5,534,900 A 7/1996 Ohno et al.
6,168,263 B1 * 1/2001 Nojima et al. ..... 347/54
6,183,070 B1 * 2/2001 Hashizume ..... 347/70

FOREIGN PATENT DOCUMENTS

JP 5-50601 3/1993
JP 6-71882 3/1994

* cited by examiner

*Primary Examiner*—Raquel Yvette Gordon
(74) *Attorney, Agent, or Firm*—Cooper & Dunham LLP

(57) ABSTRACT

An electrostatic type inkjet head can be manufactured by a semiconductor manufacturing process without causing a problem inherent to a semiconductor manufacturing process. The inkjet head is produced by bonding a first body member and a second body member to each other. A plurality of vibration plates are formed on the first body member. A plurality of individual electrodes are formed on the second body member. Spacer portions are provided to at least one of the first body member and the second body member so that the first body member and the second body member are bonded to each other with the spacer portions therebetween. The spacer portions define a space providing a gap between each of the vibration plates and a respective one of the individual electrodes. Vent passages connecting each of the spaces to atmosphere are formed by the spacer portions so as to release gasses generated in the space during a manufacturing process.

14 Claims, 10 Drawing Sheets

ELECTROSTATIC TYPEINKJET HEAD HAVING A VENT PASSAGE AND A MANUFACTURING METHOD THEREOF

BACKGROUND OF THE INVENTION

1. Field of the Invention

The present invention generally relates to an inkjet head of an inkjet recording apparatus and, more particularly, to an inkjet head having a vibration plate which is deformed by an electrostatic force so as to pressurize ink stored in an ink chamber and eject a droplet of the ink from an inkjet nozzle.

2. Description of the Related Art

An inkjet printer has become popular for a personal use since the inkjet printer is smaller and less expensive than other printing apparatuses such as an electrophotographic printer.

The inkjet printer has an inkjet head which projects droplets of ink toward a recording medium such as a recording paper so as to form a dot image on the recording medium. Generally, the inkjet head is classified into three types, such as a thermal head (bubble head), a piezoelectric head and an electrostatic head, according to its principle of formation of a droplet of ink.

In the thermal head, ink is pressurized by a bubble generated by a heater provided in an ink chamber so that a droplet of ink is ejected from a inkjet nozzle by the thus-generated pressure. In the piezoelectric head, ink stored in an ink chamber is pressurized by deformation of a piezoelectric material so that a droplet of ink is ejected from an inkjet nozzle by the thus-generated pressure.

On the other hand, the electrostatic head projects a droplet of ink by deformation (warp) of a vibration plate generated by an electrostatic force. The electrostatic head can be manufactured by a fine machining technique such as a conventional semiconductor manufacturing process. Accordingly, the electrostatic head is suitable for a high-density nozzle structure having a fine structure.

In the electrostatic head, the vibration plate is formed by a semiconductor manufacturing process so that the vibration plate is formed as an electrode which is separated from another electrode with a predetermined small gap therebetween. When the electrostatic head is formed by bonding two silicon wafers, formation of such a small gap generally provides a sealed space between the vibration plate formed in one of the silicon wafers and another electrode formed in the other one of the silicon wafers. Accordingly, there is a problem in that the silicon wafers cannot be completely bonded to each other due to degassing of a material in the sealed chamber during a process for bonding the silicon wafers. That is, gasses generated by degassing may form a void in a bonding area between the silicon wafers.

SUMMARY OF THE INVENTION

It is a general object of the present invention to provide an improved and useful inkjet head in which the above-mentioned problem is eliminated.

A more specific object of the present invention is to provide an electrostatic type inkjet head which can be manufactured by a semiconductor manufacturing process without causing a problem inherent to the semiconductor manufacturing process.

In order to achieve the above-mentioned objects, there is provided according to one aspect of the present invention an inkjet head ejecting a droplet of ink by an electrostatic force generated between a first electrode and a second electrode, the inkjet head comprising:

a first body member having a plurality of vibration plates each of which corresponds to the first electrode;

a second body member having a plurality of individual electrodes each of which corresponds to the second electrode;

spacer portions provided to at least one of the first body member and the second body member so that the first body member and the second body member are bonded to each other with the spacer portions therebetween so as to define a space providing a gap between each of the vibration plates and a respective one of the individual electrodes; and vent passages defined by the spacer portions, the vent passages connecting each of the spaces to atmosphere.

According to the above-mentioned invention, gasses generated by degassing in the spaces providing the gaps can be released to atmosphere through the vent passages when the first body member and the second body member are bonded to each other. Thus, a uniform gap can be formed between each of the vibration plates and the respective one of the individual electrodes. This results in a uniform vibration characteristic of the vibration plates, resulting in a uniform droplet of ink being ejected from inkjet nozzles. Thus, an ink image formed by the inkjet head according to the present invention has a good image quality. Additionally, since the gap between each of the vibration plates and the respective one of the individual electrodes is uniform, it is easy to drive the vibration plates at a relatively low voltage.

Additionally, there is provided according to another aspect of the present invention an inkjet head ejecting a droplet of ink by an electrostatic force generated between a first electrode and a second electrode, the inkjet head comprising:

a first body member having a plurality of vibration plates each of which corresponds to the first electrode;

a second body member having a plurality of individual electrodes each of which corresponds to the second electrode; and spacer portions provided to at least one of the first body member and the second body member so that the first body member and the second body member are bonded to each other with the spacer portions therebetween so as to define a space providing a gap between each of the vibration plates and a respective one of the individual electrodes, wherein each edge of the spacer portions contacting the first body member is depressed so that the spacer portions are bonded to the first body member without edges being in contact with the first body member.

According to this invention, since the edges of the spacer portions are depressed, the spacer portions can be well bonded to the first body member if a protrusion is formed on the edges of the spacer portions during a manufacturing process of the inkjet head.

Additionally, there is provided according to another aspect of the present invention an inkjet head ejecting a droplet of ink by an electrostatic force, the inkjet head comprising:

a vibration plate defining a first electrode;

an individual electrode defining a second electrode, the individual electrode being located opposite to the vibration plate so as to generate the electrostatic force; and protrusion patterns formed on at least one of the vibration plate and said individual electrode so that the protrusion patterns are positioned between the vibration plate and the individual electrode.

According to this invention, each of the vibration plates is prevented from sticking to the respective one of the individual electrodes or a protective film formed on each of the individual electrodes by the protrusion patterns formed on each of the individual electrodes or the protective film. The protrusion patterns can be formed as insulating layers so that the effective gap between each of the vibration plates and the respective one of the individual electrodes is decreased which facilitates movement of each of the vibration plates by the electrostatic attracting force, particularly at an initial stage of movement. This is because an electric field at the insulating layers is increased since the permittivity of the oxidation layer is about four times that of an air gap. Additionally, the protrusion patterns can be used as a stopper for the movement of each of the vibration plates when the inkjet head is rendered to be of the contact type. In such a case, the displacement of each of the vibration plates can be precisely set by the stopper by providing a relatively large drive voltage even if the drive voltage fluctuates or if the gap distance fluctuates.

Additionally, according to another aspect of the present invention, methods for manufacturing the above-mentioned inkjet heads are provided.

Other objects, features and advantages of the present invention will become more apparent from the following detailed description when read in conjunction with the accompanying drawings.

DETAILED DESCRIPTION OF THE PREFERRED EMBODIMENTS

Figure 1A:
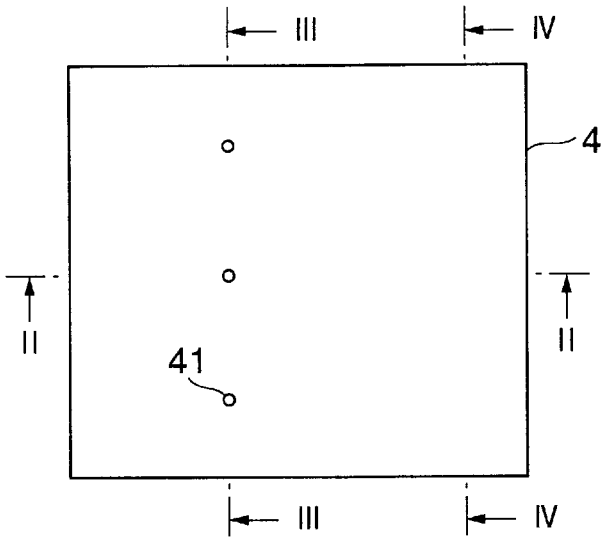
FIG. 1A is a plane view of an inkjet head according to a first embodiment of the present invention.
Figure 1B:
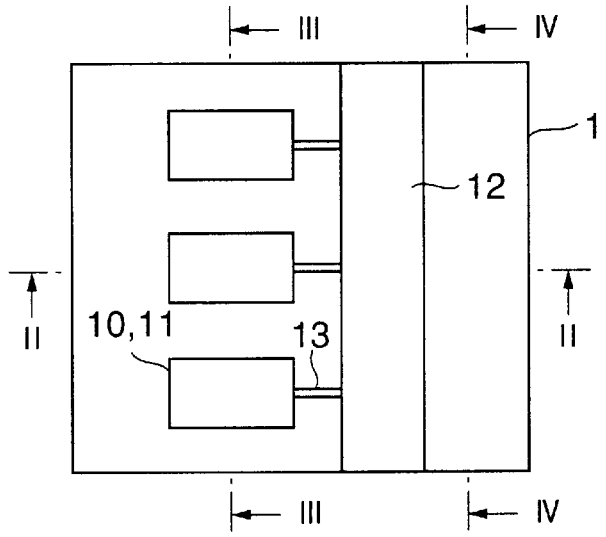
FIG. 1B is a plane view of an inkjet head shown in FIG. 1A in a state in which a nozzle plate is removed.
Figure 1C:
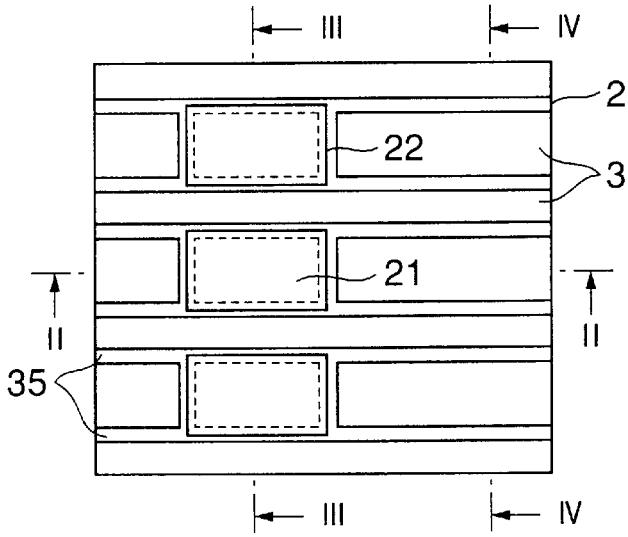
FIG. 1C is a plane view of an inkjet head shown in FIG. 1A in a state in which the nozzle plate and a first body member are removed.
Figure 2:
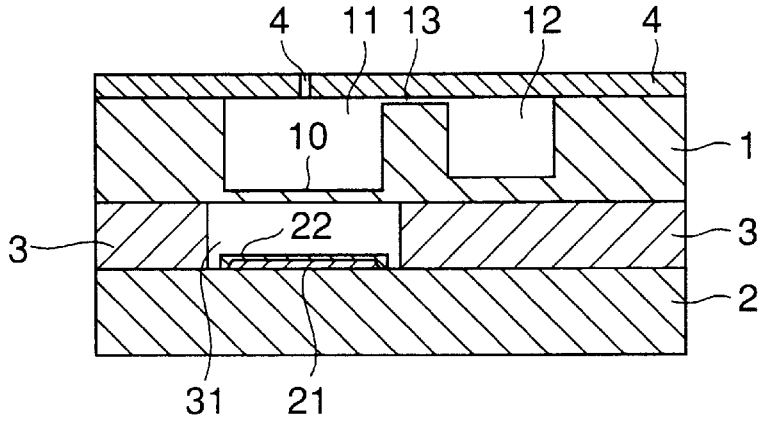
FIG. 2 is a cross-sectional view of the inkjet head taken along a line II—II of FIG. 1A.
Figure 3:
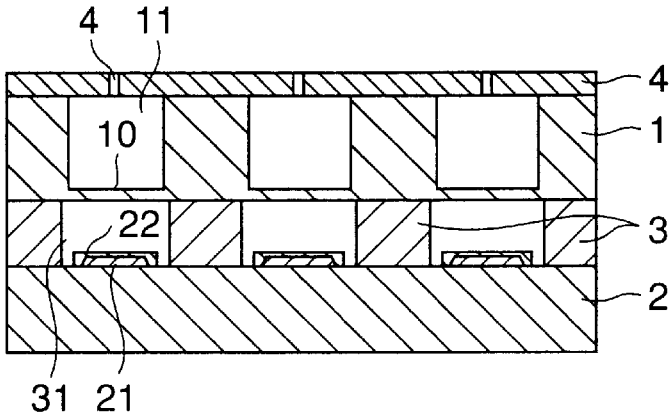
FIG. 3 is a cross-sectional view of the inkjet head taken along a line III—III of FIG. 1A.
Figure 4:
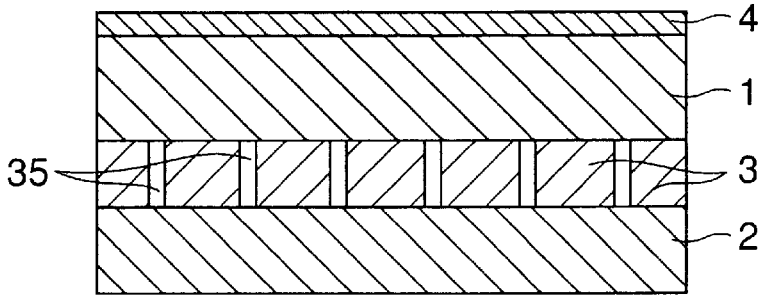
FIG. 4 is a cross-sectional view of the inkjet head taken along a line IV—IV of FIG. 1A.

A description will now be given of a first embodiment of the present invention. FIG. 1A is a plane view of an inkjet head according to the first embodiment of the present invention. FIG. 1B is a plane view of an inkjet head shown in FIG. 1A in a state in which a nozzle plate is removed. FIG. 1C is a plane view of an inkjet head shown in FIG. 1A in a state in which the nozzle plate and a first body member are removed. FIG. 2 is a cross-sectional view of the inkjet head taken along a line II—II of FIG. 1A. FIG. 3 is a cross-sectional view of the inkjet head taken along a line III—III of FIG. 1A. FIG. 4 is a cross-sectional view of the inkjet head taken along a line IV—IV of FIG. 1A.

As shown in FIG. 2, the inkjet head according to the first embodiment of the present invention comprises a first body member 1, a second body member 2, spacer portions 3 between the first body member 1 and the second body member 2, and a nozzle plate 4 covering the first body member 1.

A plurality of inkjet nozzles 41 are formed in the nozzle plate 4. Each of the nozzles 41 is connected to a respective one of ink pressurizing chambers 11 formed in the first body member 1. A bottom of each of the ink pressurizing chambers 11 serves as a vibration plate 10. A common ink chamber 12 is provided in the first body chamber The common ink chamber 12 is connected to each of the ink pressurizing chambers 11 via a fluid passage 13 through which ink in the common ink chamber 12 is supplied to the ink pressurizing chambers 11.

The second body member 2 is provided with a plurality of individual electrodes 21. Each of the individual electrodes 21 is provided directly under a respective one of the vibration plates 10. Each of the individual electrodes 21 is covered by a protective film 22.

In this embodiment, the spacer portions 3 are interposed between the first body member 1 and the second body member 2 so that spaces 31, each of which defines a predetermined gap between each of the vibration plates 10 and the respective one of the individual electrodes 21, are formed and vent passages 35 shown in FIG. 4 are also formed.

The spacer portions 3 are provided so as to define an accurate gap between each of the vibration plates 10 and the respective one of the individual electrodes 21. More specifically, the spacer portions 3 are provided so as to define an accurate effective gap which is a distance between each of the vibration plates 10 and the protective film 22 of the respective one of the individual electrodes 21.

In the above-mentioned structure of the inkjet head, each of the vibration plates 10 serves as an electrode so that a predetermined voltage is applied between each of the vibration plates 10 and the respective one of the individual electrodes 21. When the predetermined voltage is applied between one of the vibration plates 10 and the respective one of the individual electrodes 21, an electrostatic force is exerted on the vibration plate 10. Accordingly, each of the vibration plates 10 is attracted toward the respective one of the individual electrodes 21. When the predetermined voltage is canceled, each of the vibration plates 10 returns to its original position. Thereby, ink in each of the ink pressurizing chambers 11 is pressurized by the movement of each of the vibration plates 10, and a droplet of the ink is ejected from the respective one of the inkjet nozzles 41.

In this embodiment, the spaces 31 and the vent passages 35 are formed by the spacer portions 3. Each of the vent passages 35 serves to connect each of the spaces 31 to atmosphere. Accordingly, when the first body member 1 and the second body member 2 are bonded with the spacer portions 3 therebetween, each of the spaces 31 is open to atmosphere via the vent passages 35. Thus, air and gas in each of the spaces 31 can be discharged to atmosphere via the vent passages 35. This prevents formation of a void in a bonding area between the first body member 1 and the second body member 2.

In the present embodiment, the first body member 1 and the second body member 2 are formed by silicon wafers by using a conventional semiconductor manufacturing process. The spacer portions 3 can be formed on the second body member 2 by a silicon oxide layer. In such a case, the spacer portions 3 are integrally formed with the second body member 2. Thus, the spacer portions 3 can be bonded to the first body member 1 by applying heat in the same manner as that of a manufacturing process for manufacturing an SOI (silicon on insulator) substrate. In the manufacturing process of the SOI substrate, a silicon layer and a silicon oxide layer are bonded to each other by heating at a temperature of about 1,000 to 1,100° C. This bonding method is generally referred to as a direct bonding.

When the first body member 1 and the second body member 2 provided with the individual electrodes 21 and the protective films 22 are heated, degassing occurs in the spaces 31. If the spaces 31 are completely sealed, the degassing may cause a void formed in the bonding area between the spacer portions 3 and the first body member 1. Generation of the void is promoted when bonding is performed at a relatively low temperature since dehydration is not completed and water vapor remains between the bonding area.

If such a void is formed, the gap between each of the vibration plates 10 and the respective one of the individual electrodes 21 cannot be uniform. Accordingly, if such a void is formed, deformation or warp of each of the vibration plates 10 vary from each other when the same voltage is applied. Thus, an amount of droplet fluctuates which results in deterioration of an image quality.

However, according to the inkjet head of the present embodiment, gasses generated by degassing can be released to atmosphere through the vent passages 35 when the first body member 1 and the second body member 2 are bonded to each other. Thus, a uniform gap can be formed between each of the vibration plates 10 and the respective one of the individual electrodes 21. This results in a uniform vibration characteristic of the vibration plates 10, resulting in a uniform droplet of ink ejected from the inkjet nozzles 41. Thus, an ink image formed by the inkjet head according to the present embodiment has a good image quality. Additionally, since the gap between each of the vibration plates 10 and the respective one of the individual electrodes 21 is uniform, it is easy to drive the vibration plates 10 at a relatively low voltage.

Since the inkjet head according to the present embodiment uses an electrostatic attracting force between the electrodes, a bonding state required for an SOI substrate is not needed. That is, in the bonding performed in the present embodiment, a chemical bonding structure under microscopic observation can be uneven as long as there is no void generated in the bonding area. Accordingly, the bonding process for the inkjet head according to the present embodiment can be performed at a temperature lower than a bonding temperature required for the SOI substrate.

In the present embodiment, the vent passages 35 are provided by removing the spacer portions 3. However, vent passages 36 shown in FIG. 5 may be substituted for the vent passages 35. That is, the vent passages 36 are formed as grooves formed on the spacer portions 3. Alternatively, the vent passages may be formed as through holes extending in the spacer portions 3. In such as case, the bonding area between the spacer portions 3 and the first body member 1 is increased.

Additionally, the spacer portions 3 may be formed on the first body member 1 instead of the second body member 2, or the spacer portions 3 may be formed on both the first and second body members 1 and 2.

In the present embodiment, the spacer portions 3 are formed by a silicon oxide layer provided on the second body member 2 made of a silicon wafer. However, the spacer portions 3 may be formed of a metal material which is eutectic with the material of the first body member 1 and/or the second body member 2. For example, when each of the first body member 1 and the second body member 2 is formed of a silicon substrate, the spacer portions 3 may be made of Au, AuSb, Ti or TiN. According to this structure, the first body member 1 and the second body member 2 can be electrically connected to each other by the spacer portions 3. Thus, the electrodes formed by the vibration plates 10 can be electrically connected to the second body member 2 via the spacer portions 3 made of a metal material. In this case, lead wires for providing a voltage to the electrodes formed on the first body member 1 and the second body member 2 can be extended from only the second body member 2.

Additionally, each of the spacer portions 3 may be formed of a layered structure composed of a plurality of layers made of different materials in which the layer contacting the first body member 1 is formed of a metal material which is eutectic with the material of the first body member 1 and the layer contacting the second body member 2 is formed of a metal material which is eutectic with the material of the second body member. According to this structure of the spacer portions 3, the spacer portions 3 can be bonded with both the first body member 1 and the second body member 2 in a stable bonding state.

The layered structure of the spacer portions 3 may include three or more layers in which a middle layer is used for adjusting a thickness of the spacer portions 3. In this structure, the middle layer is not needed to be a metal material which is eutectic with the material of the first body member 1 or the second body member 2. That is, the middle layer is provided for adjusting the gap between each of the vibration plates 10 and the respective one of the individual electrodes 21 while the top and bottom layers are provided for achieving a stable bonding with the first body member 1 and/or the second body member 2. Thus, a stable bonding can be achieved while maintaining the uniform gap between each of the vibration plates 10 and the respective one of the individual electrodes 21.

As mentioned above, according to the inkjet head of the present embodiment, the spacer portions 3 facilitate bonding at a low temperature and also facilitate a precise control of a gap between each of the vibration plates 10 and the respective one of the individual electrodes 21 since the bonding is achieved by a chemical bonding which requires no additional material such as adhesive between the materials to be bonded.

Figure 6:
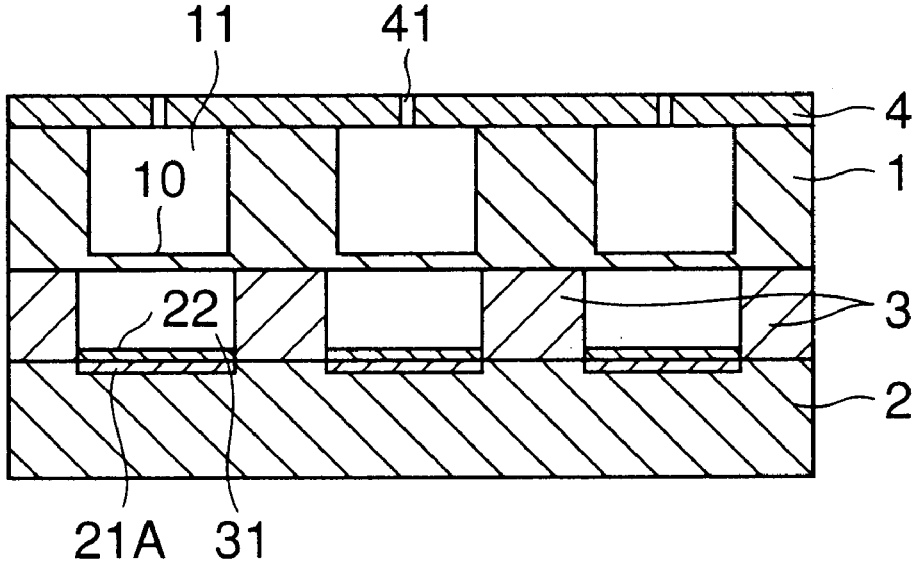
FIG. 6 is a cross-sectional view of an inkjet head according to a second embodiment of the present invention.

A description will now be given, with reference to FIG. 6, of a second embodiment of the present invention. FIG. 6 is a cross-sectional view of an inkjet head according to the second embodiment of the present invention. In FIG. 6, parts that are the same as the parts shown in FIG. 2 are given the same reference numerals, and descriptions thereof will be omitted.

The inkjet head according to the second embodiment of the present invention has the same structure as the inkjet head according to the first embodiment of the present invention except for the individual electrodes 21 being replaced by individual electrodes 21A which are impurity diffusion layers. That is, in the inkjet head according to the second embodiment, each of the electrodes opposite to the respective one of the vibration plates 10 provided in the first body member 1 is formed in the second body member 2. Accordingly, there is no need to form the individual electrodes 21*a* by a plating method or a deposition method such as a vapor deposition, a chemical vapor deposition or a sputtering. The individual electrodes 21A formed of the impurity diffusion layer provide a uniform thickness of the layer and a surface having less unevenness than a layer formed by the plating method or the deposition method. Thus, the gap between each of the vibration plates 10 and the respective one of the individual electrodes 21A can be uniform.

Additionally, since the individual electrodes 21A are formed as the impurity diffusion layer, the protective layer 22 covering each of the individual electrodes 21 can be a passivation layer which can be formed by oxidation or nitridation of a surface of a silicon substrate. The oxidation layer formed on a silicon substrate has a higher insulating effect and less amount of trapped charge than a layer obtained by sputtering or chemical vapor deposition.

Figure 7A:
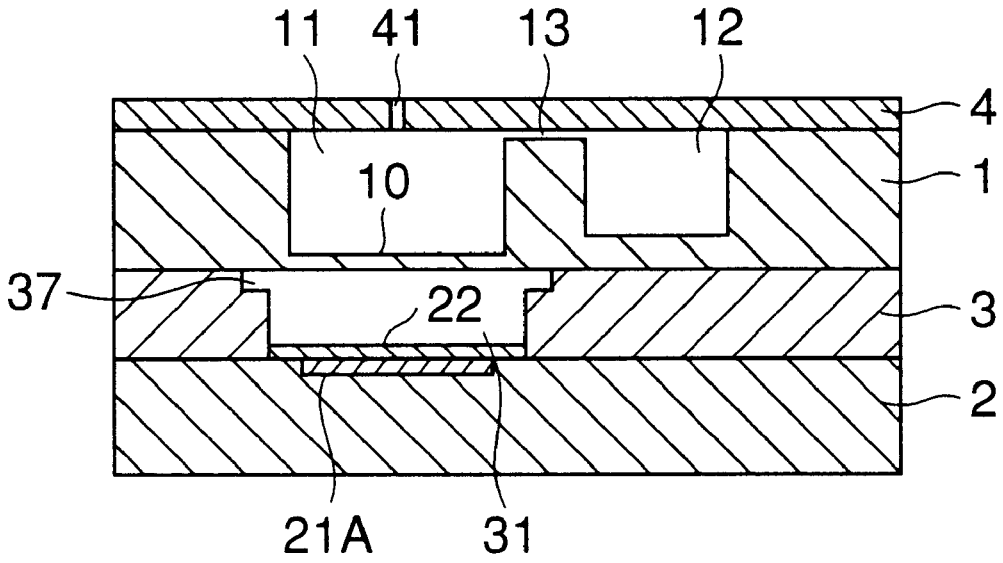
FIGS.7A and 7B are cross-sectional views of an inkjet head according to a third embodiment of the present invention.
Figure 7B:
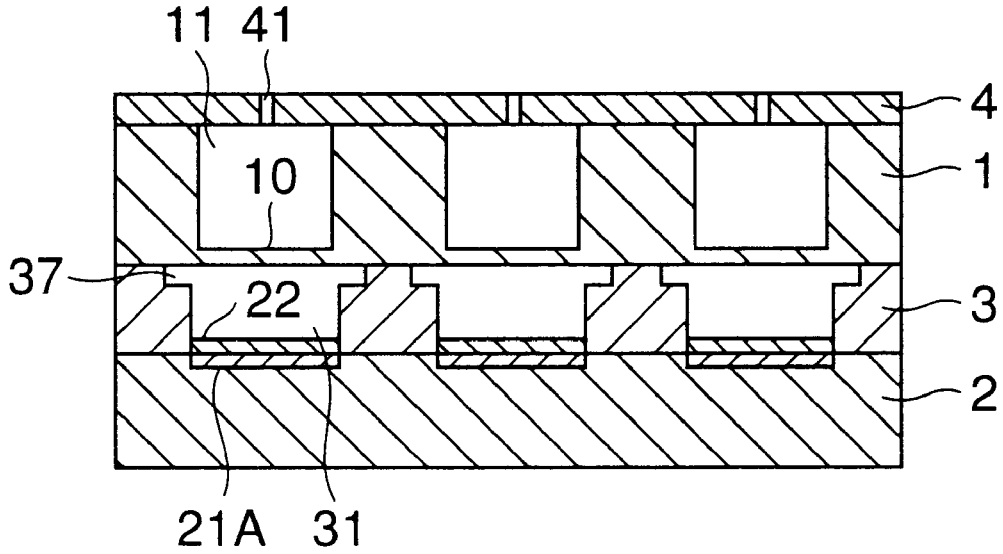

A description will now be given, with reference to FIGS. 7A and 7B, of a third embodiment of the present invention. FIGS. 7A and 7B are cross-sectional views of an inkjet head according to the third embodiment of the present invention. It should be noted that the cross-sectional view of FIG. 7A is taken along a line corresponding to line II—II of FIG. 2, and the cross-sectional view of FIG. 7B is taken along a line corresponding to line III—III of FIG. 3. In FIGS. 7A and 7B, parts that are the same as the parts shown in FIGS. 2 and 6 are given the same reference numerals, and descriptions thereof will be omitted.

The inkjet head according to the third embodiment of the present invention has the same structure as the inkjet head according to the second embodiment of the present invention except for a depression 37 provided to each corner (shoulder portion) of the spacer portions 3. The depression 37 is formed so as to eliminate a protrusion formed on the shoulder portion when the protective film 22 is formed on the second body member 2.

Figure 8:
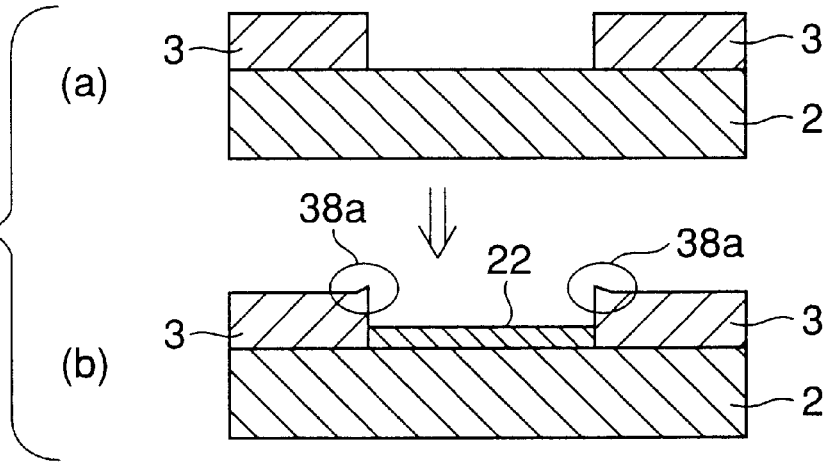
FIG. 8 is an illustration for explaining formation of a protrusion on a shoulder of a spacer portion.
Figure 9:
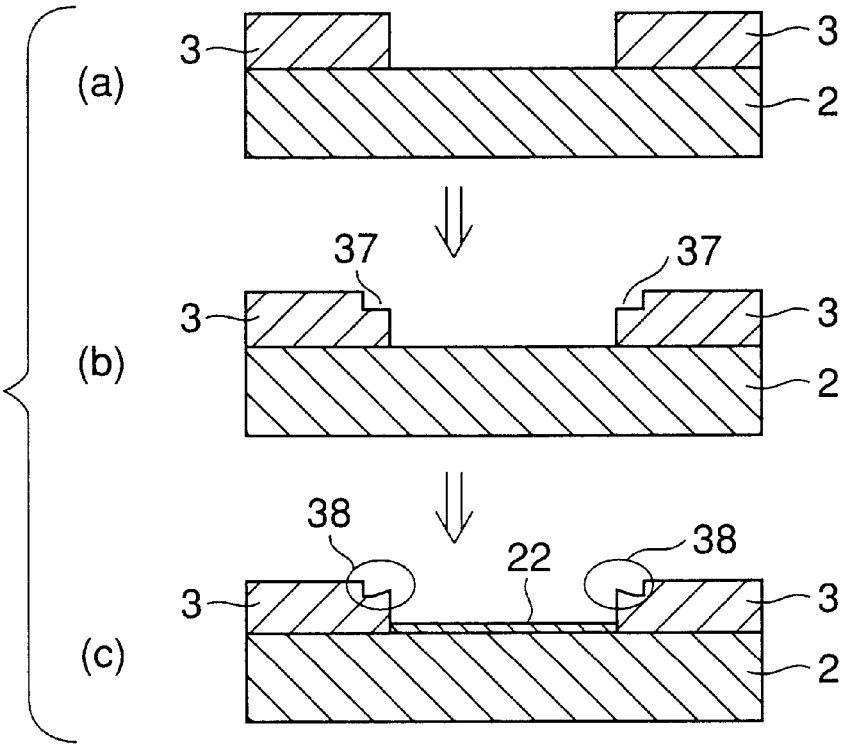
FIG. 9 is an illustration for explaining a manufacturing process for forming the depression.

FIG. 8 is an illustration for explaining formation of the protrusion on the shoulder of the spacer portions 3. FIG. 9 is an illustration for explaining a manufacturing process for forming the depression 37.

As shown in FIG. 8, when the protective film 22 is formed on the second body member 2 by forming a passivation layer, a protrusion 38*a* is also formed on a shoulder of the spacer portions 3. The protrusion 38*a* protrudes from the plane of the surface of each of the spacer portions 3 as shown in FIG. 8-(*b*). If the first body member 1 is bonded to the spacer portions 3 by a direct bonding, the first body member 1 is bonded only to the protrusions 38*a* of the spacer portions 3. Thus, in such a case, a strong bonding cannot be achieved. Additionally, if the bonding is made between the protrusions 38*a* and the first body member 1, the gap between each of the vibration plates and the respective one of the individual electrodes 21 (protective films 22) is undesirably changed.

In the inkjet head according to the present embodiment, the depression 37 is formed on each shoulder portion of the spacer portions 3 that surround the protective film 22. As shown in FIG. 9, the depression 37 is formed before the protective film 22 is formed on the second body member 2. A depth of the depression 37 is set so that a height of the protrusion 38 is smaller than the depth of the depression. Accordingly, even if the protrusion 38 is formed on the corner of the depression 37, the protrusion 38 does not affect the direct bonding between the first body member 1 and the spacer portions 3.

Figure 10:
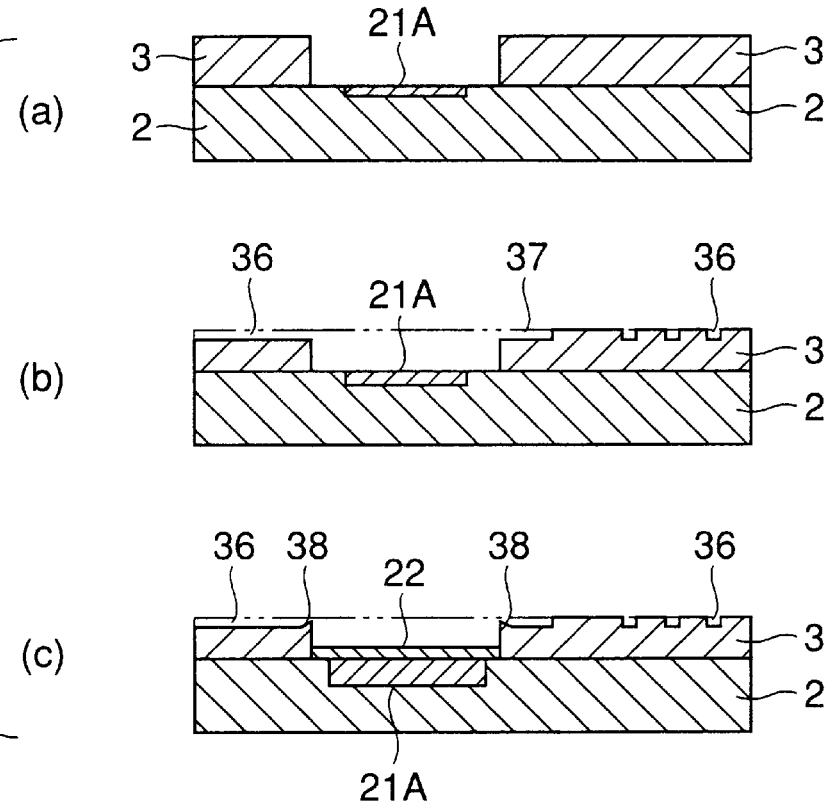
FIG. 10 is an illustration for explaining a part of a process for manufacturing an inkjet head according to a fourth embodiment of the present invention.

A description will now be given, with reference to FIG. 10, of a fourth embodiment of the present invention. FIG. 10 is an illustration for explaining a part of a process for manufacturing an inkjet head according to the fourth embodiment of the present invention. In FIG. 10, parts that are the same as the parts shown in FIGS. 2 and 9 are given the same reference numerals, and descriptions thereof will be omitted.

Figure 5:
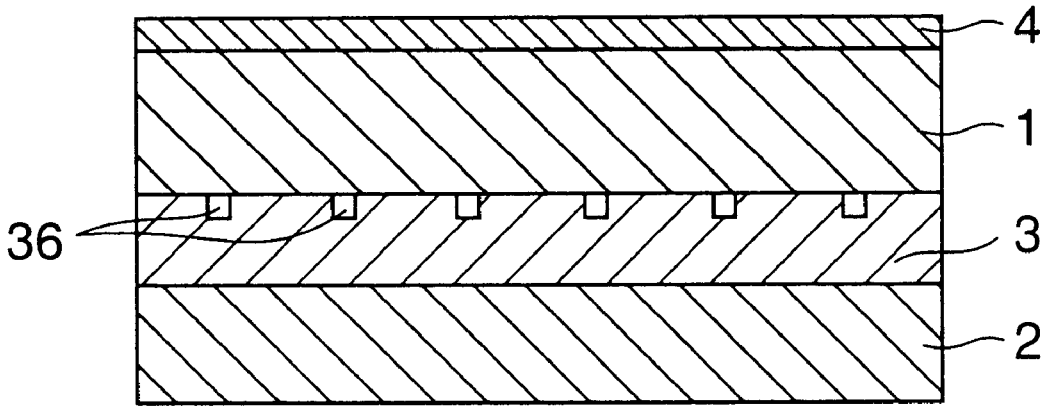
FIG. 5 is a cross-sectional view of a variation of the inkjet head shown in FIG. 1A.

The inkjet head according to the fourth embodiment of the present invention has the vent passages 36 as shown in FIG. 5. The vent passages 36 are formed as grooves formed on the spacer portions 3. Additionally, the inkjet head according to the fourth embodiment of the present invention has depressions formed on shoulders of the spacer portions 3. The feature of the inkjet head according to the present embodiment is that some of the vent passages 36 serve as the depressions formed on the shoulders of the spacer portions 3.

The depressions and the vent passages 36 are formed in the same process as shown in FIG. 10. First, a part of the silicon oxide layer (spacer portion 3) formed on the second body member 2 is removed so as to expose the individual electrode 21 as shown in FIG. 10-(*a*). Then, the vent passages 36 and the depressions 37 are simultaneously formed on the spacer portions 3 as shown in FIG. 10-(*b*). Thereafter, the protective film 22 is formed on the individual electrode 21 as shown in FIG. 10-(*c*). When the protective film 22 is formed, protrusions 38 are also formed. However, the protrusions 38 are formed on the shoulders of the depressions 37, and, thereby, the protrusions 38 do not affect bonding between the spacer portions 3 and the first body member 1.

Figure 11:
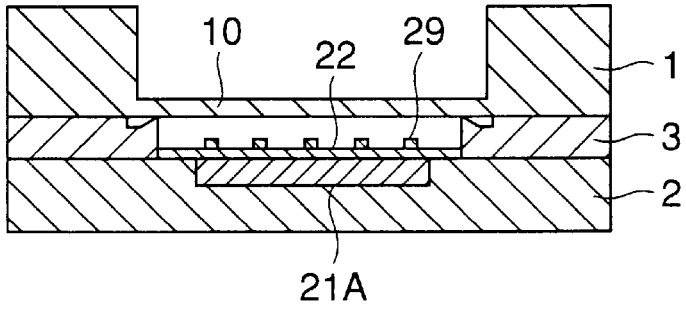
FIG. 11 is a cross-sectional view of an inkjet head according to a fifth embodiment of the present invention.

A description will now be given, with reference to FIG. 11, of a fifth embodiment of the present invention. FIG. 11 is a cross-sectional view of an inkjet head according to the fifth embodiment of the present invention. In FIG. 11, parts that are the same as the parts shown in FIG. 6 are given the same reference numerals, and descriptions thereof will be omitted.

The inkjet head according to the fifth embodiment of the present invention has the same structure as the inkjet had according to the third embodiment of the present invention except for protrusion patterns 29 formed on the protective film 22. The protrusion patterns 29 are located directly under the vibration plate 10. Accordingly, when the vibration plate 10 moves (deforms) toward the individual electrode 21A, the vibration plate 10 does not directly contact the protective film 22 so that the vibration plate 10 is prevented from sticking to the protective film 22.

Generally, the electrostatic inkjet heads are classified into two types according to movement of the vibration plate. One is a non-contact type and the other is a contact type. In the non-contact type electrostatic inkjet head, the electrostatic attracting force exerted on the vibration plate is limited to be less than a returning force of the vibration plate. That is, the vibration plate does not contact the opposing electrode (protective film). On the other hand, in the contact type electrostatic inkjet head, displacement of the vibration plate is limited by the opposing electrode (protective film). That is, the movement of the vibration plate is stopped by the electrode (protective film).

As mentioned above, in the contact type inkjet head, the vibration plate contacts the protective film each time the vibration plate is attracted by the opposing electrode (individual electrode). In this case, since each of the surface of the vibration plate and the surface of the protective film is nearly a mirror surface, the vibration plate may stick to the protective film due to physical adhesion. If the vibration plate sticks to the protective film, the vibration film does not return to its original position for a certain period which deteriorates a normal inkjet operation. It should be noted that, in the non-contact type inkjet head, the vibration plate may contact the protective film of the opposing electrode due to an abnormal condition. Such an abnormal condition occurs when a noise enters a drive voltage applied to the electrodes or when a particle enters in a gap between the vibration plate and the individual electrode which decreases an effective gap between the vibration plate and the individual electrode. In such a case, the vibration plate may stick to the protective film of the opposing electrode.

In the present embodiment, the vibration plate 10 is prevented from sticking to the protective film 22 by the protrusion patters 29 formed on the protective film 22. The protrusion patterns 29 can be formed by insulating layers so that the effective gap between the vibration plate 10 and the individual electrode 21 is decreased which facilitates movement of the vibration plate 10 by the electrostatic attracting force, particularly at an initial stage of movement. This is because an electric field at the insulating layers is increased since the permittivity of the oxidation layer is about four times that of the air gap.

Additionally, the protrusion patterns 29 can be used as a stopper for the movement of the vibration plate 10 when the inkjet head is rendered to be of the contact type. In such a case, the displacement of the vibration plate 10 can be precisely set by the stopper by providing a relatively large drive voltage even if the drive voltage fluctuates or if the gap distance fluctuates.

The protrusion patterns 29 can be formed in any shape such as circles, squares, polygons or stripes. However, a height and a pitch of the protrusion patterns 29 may influence a movement of the vibration plate 10. Additionally, a total area and a density of the protrusion patterns 29 may also influence a movement of the vibration plate 10. Accordingly, these factors should be determined according to the size of the vibration plate 10 and the drive voltage applied thereto.

Figure 12:
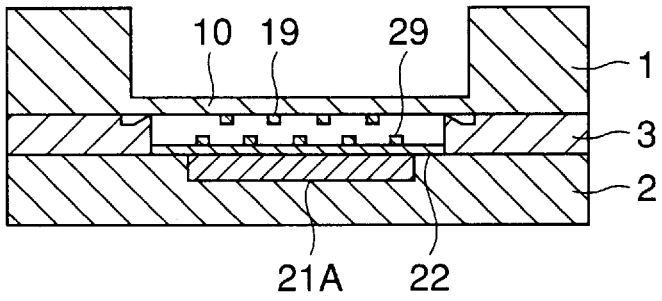
FIG. 12 is a cross-sectional view of a variation of the inkjet head according to the fifth embodiment of the present invention.

FIG. 12 is a cross-sectional view of a variation of the inkjet head according to the fifth embodiment of the present invention. As shown in FIG. 12, protrusion patterns 19 are formed on the vibration plate 10 in addition to the protrusion patterns 29 formed on the protective film 22. It should be noted that only the protrusion patterns 19 may be formed on the vibration plate 10.

Figure 13:
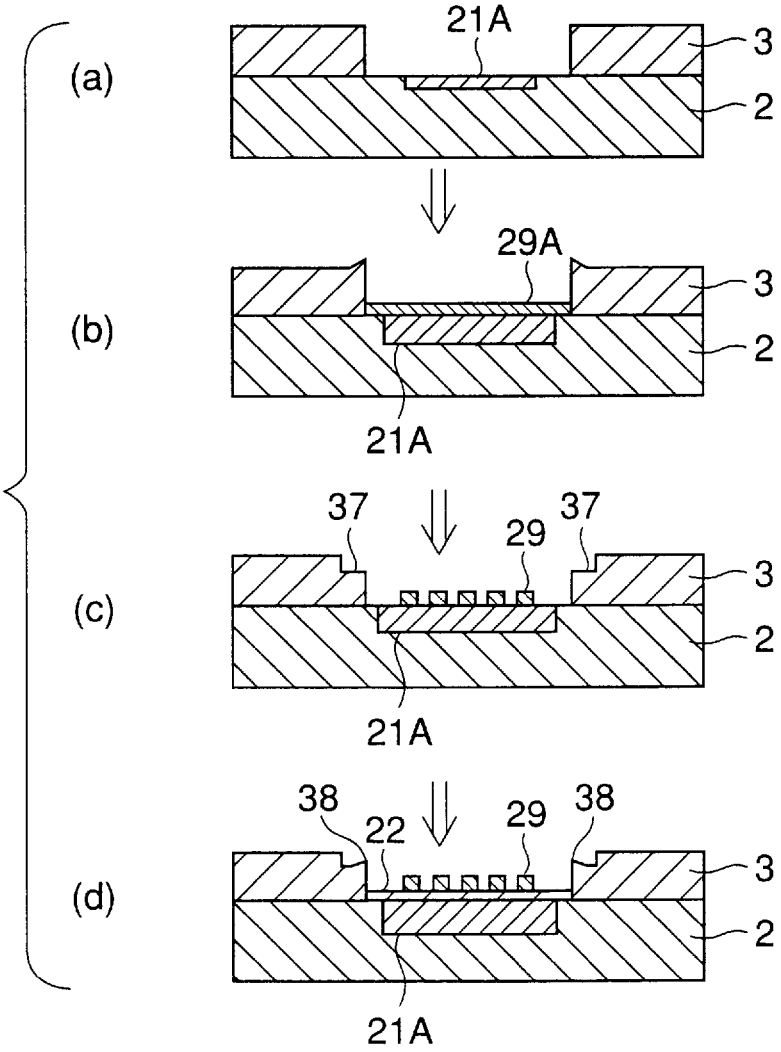
FIG. 13 is an illustration for explaining a process for producing protrusion patterns on a protective film.

FIG. 13 is an illustration for explaining a process for producing the protrusion patterns 29 on the protective film 22. First, a part of the spacer portions 3 formed on the second body member 2 is removed, and an impurity diffusion layer is formed in the second body member which impurity diffusion layer serves as the individual electrode 21A as shown in FIG. 13-(*a*). Then, an oxidation layer or an oxidation nitriding layer 29*a* is formed on the individual electrode 21A as shown in FIG. 13-(*b*). Thereafter, the depressions 37 and the protrusion patterns 29 are simultaneously formed as shown in FIG. 13-(*c*). Then, the protective layer 22 is formed on the individual electrode 21A as shown in FIG. 13-(*d*).

In the above-mentioned process, masking for forming the depressions 37 and the protrusion patterns 29 can be performed at the same time and formation of the depressions 37 and the protrusion patterns 29 are performed in the same process. Accordingly, the protrusion patterns 29 can be formed without increasing a number of masking steps. Thus, the manufacturing process is simplified which results in reduction in a manufacturing cost.

Figure 14:
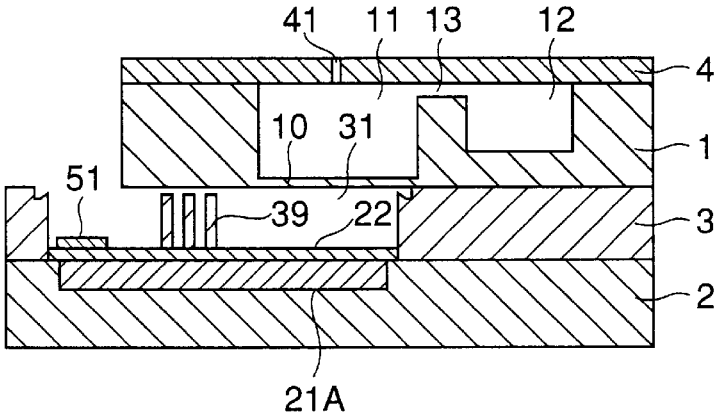
FIG. 14 is a cross-sectional view of an inkjet head according to a sixth embodiment of the present invention.

A description will now be given, with reference to FIG. 14, of a sixth embodiment of the present embodiment. FIG. 14 is a cross-sectional view of an inkjet head according to the sixth embodiment of the present invention. In FIG. 14, parts that are the same as the parts shown in FIG. 2 and 7A are given the same reference numerals, and descriptions thereof will be omitted.

The inkjet head according to the sixth embodiment of the present invention has a semi-sealing pattern 39. A gap formed between the semi-sealing pattern 39 and the first body member 1 is set smaller than about two thirds (⅔) of the effective gap between the vibration plate 10 and the individual electrode 21.

Generally, in the non-contact type inkjet head, the maximum displacement of the vibration plate 10 must be less than one third (⅓) of the effective gap. Accordingly, it is required to prevent a particle having a size larger than about two thirds (⅔) of the effective gap from entering the space 31. Accordingly, in the present embodiment, the gap between the semi-sealing pattern 39 and the first body member 1 is set smaller than about two thirds of the effective gap.

Figure 15:
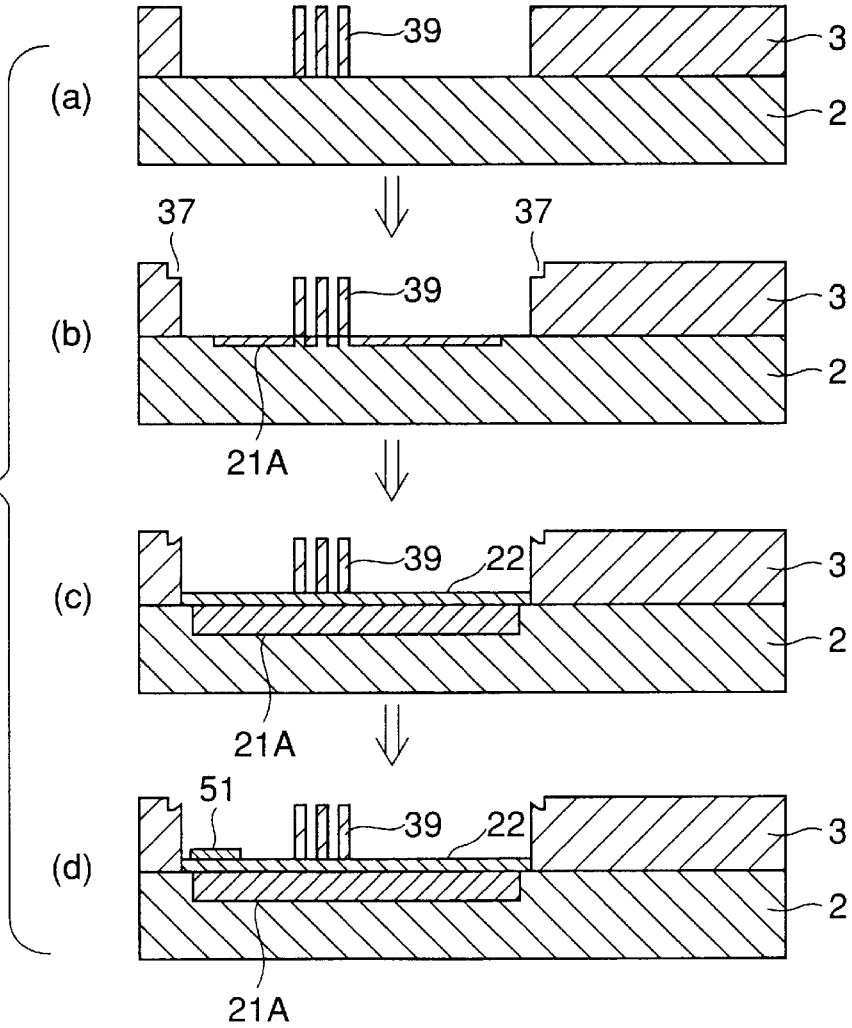
FIG. 15 is an illustration for explaining a process for producing a semi-sealing pattern shown in FIG. 14.

FIG. 15 is an illustration for explaining a process for producing the semi-sealing pattern 39 on the protective film 22. First, the spacer portions 3 and the semi-sealing pattern 39 are formed by removing a part of an oxidation layer formed on the second body member 2 as shown in FIG. 15-(*a*). Then, as shown in FIG. 15-(*b*), the depressions 37 are formed and a top portion of the semi-sealing pattern 37 is removed at the same time. Thereafter, an impurity diffusion layer is formed in the second body member 2 which impurity diffusion layer serves as the individual electrode 21A. Thereafter, an oxidation layer or an oxidation nitriding layer which is the protective film 22 is formed on the impurity diffusion layer as shown in FIG. 15-(*c*).

In the above-mentioned process, the formation of the depressions 37 and the removal of the top portion of the semi-sealing pattern 39 are performed in the same process. Accordingly, the semi-sealing pattern 39 can be formed without increasing a number of steps. Thus, the manufacturing process is simplified which results in reduction in a manufacturing cost.

Figure 16:
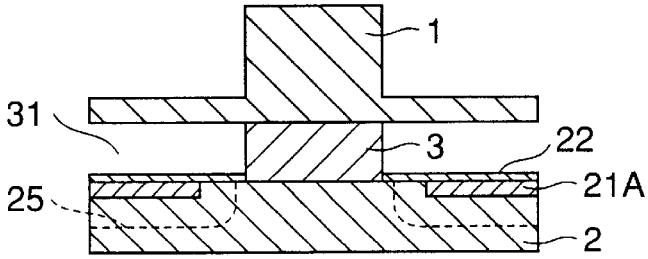
FIG. 16 is a part of an inkjet head according to a seventh embodiment of the present invention.

A description will now be given of a seventh embodiment of the present invention. FIG. 16 is a part of an inkjet head according to the seventh embodiment of the present invention. In the inkjet head according to the seventh embodiment of the present invention, an end of each the individual electrodes 21A is separated from the respective spacer portions 3 as shown in FIG. 16.

In the electrostatic inkjet head according to the above-mentioned embodiments, the vibration plate 10 is moved by an electrostatic attracting force. Thus, the first body member 1 including the vibration plates 10 is rendered to be an electrode. Thereby, a voltage equal to the voltage between each of the vibration plates 10 and the respective one of the individual electrodes 21 is applied across a portion (spacer portions 3) between the first body member 1 and the second body member 2. Accordingly, each of the spacer portions 3 which are formed by an oxidation layer may serve as a MOS transistor gate which connects between the impurity diffusion layers (individual electrodes 21A) located on opposite sides of the spacer portion 3. This corresponds to a transistor which is referred to as a field transistor in the semiconductor field. Hereinafter, this junction is referred to as a field gate. There are two problems related to the field gate, which two problems are related to each other.

FIGS. 17A, 17B, 17C and 17D are illustrations for explaining the problems caused by the individual electrode 21A having an end contacting the spacer portion 3.

One of the problems, which is referred to as a first problem, occurs when a high voltage is applied between the vibration plate 10 and the individual electrode 21A. In the inkjet head shown in FIG. 17A, the silicon substrate which constitutes the second body member 2 has a potential equal to or lower than a potential of each of the vibration plates 10. Accordingly, when a voltage is applied between each of the vibration plates 10 and the respective one of the individual electrodes 21A, the same voltage is applied between the second body member 2 and each of the individual electrodes 21A. Accordingly, a depletion layer 25 is formed around each of the individual electrodes 21A in the second body member 2. The depletion layer is indicated by dotted lines in FIG. 17B. A thickness of the depletion layer is determined by a concentration of impurity contained in the second body member (silicon substrate) 2 in the vicinity of the impurity diffusion layer (individual electrode 21A). Since the thickness of the depletion layer is increased as the concentration of impurity is decreased, a withstand voltage (junction withstand voltage) between each of the individual electrodes 21A and the silicon substrate (second body member 2) is increased. In practice, the concentration of impurity is determined based on the drive voltage applied to the vibration plates 10. When a high voltage is applied between each of the vibration plates 10 and the respective one of the individual electrodes 21A, the field gate and or a portion overlapping the depletion layer is provided with a strong electric field. Accordingly, the depletion layer near the surface of the substrate is compressed as indicated by a dotted line in FIG. 17C. Thus, there is a problem in that the junction withstand voltage is decreased.

Figure 17A:
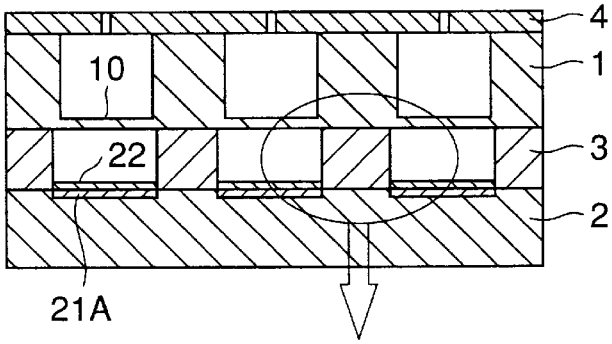
FIGS. 17A, 17B, 17C and 17D are illustrations for explaining problems caused by an individual electrode having an end contacting a spacer portion.
Figure 17B:
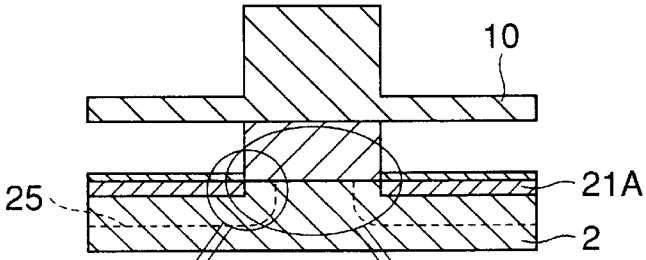
Figure 17C:
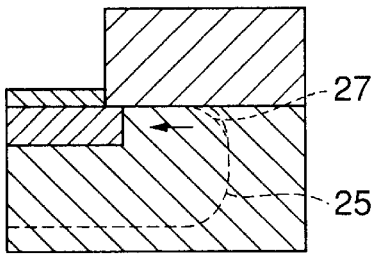
Figure 17D:
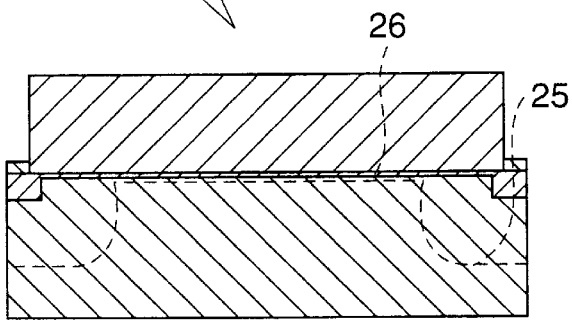

The other problem, which is referred to as a second problem, occurs when the concentration of impurity under the field gate is decreased to a level at which a punch-through occurs between the impurity diffusion layers (individual electrodes 21A). The punch-through is a state in which the field transistor is turned on. FIG. 17D illustrates this state.

In FIG. 17D, numeral 25 denotes a depletion layer, and 26 denotes an inverted layer. For example, when the spacer portions 3 are formed as oxidation layers on the second body member 2, the impurity near the surface of the substrate (second body member 2) is drawn out which results in a decrease in the concentration of impurity. This may form a reverse channel or the inverted layer 26 may be easily formed near the surface of the substrate. This phenomenon often occurs in a p-channel substrate (boron substrate).

As mentioned above, the junction withstand voltage is decreased as the concentration of impurity under the field gate is increased, and a punch-through tends to occur as the concentration of impurity is decreased. When the drive voltage applied to the vibration plate 10 is low, both the first and second problems can be eliminated but the process control is not easy. Since it becomes more difficult to decreased the drive voltage as the density of the electrodes is increased, the above-mentioned problem becomes more difficult to solve.

The inkjet head according to the seventh embodiment of the present invention attempts to solve the above-mentioned problem. According to the present embodiment, the impurity diffusion layer (individual electrode 21A) and the depletion layer 25 thereof are separated (offset) from the field gate. Accordingly, a compression of the depletion layer does not occur, and, thereby, the junction withstand voltage does not decrease. Additionally, if the inverted layer is formed due lack of impurity under the field gate or if the polarity is reversed, a punch-through hardly occurs since there is an offset between the impurity diffusion layer and the field gate.

Figure 18:
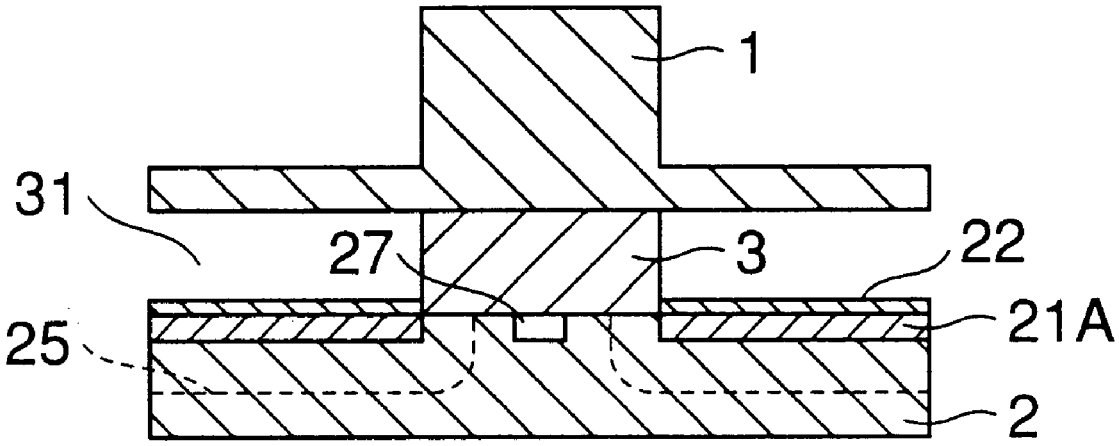
FIG. 18 is a cross-sectional view showing a punch through stopper.

In order to solve the above-mentioned problem, a punch-through stopper may be formed under the field gate. FIG. 18 is a cross-sectional view showing the punch through stopper. The punch through stopper 28 is referred to as a field dope which is a well-established technique in the semiconductor field. The field dope is used so as to prevent a field transistor action by increasing the concentration of impurity only near the surface of the substrate. This technique mainly solves the second problem.

However, if the field dope is introduced into an area in which the impurity diffusion layer (individual electrode 21A) and the depletion layer 25 are formable, the above-mentioned first problem occurs. Accordingly, as shown in FIG. 18, the field dope 27 must be formed in an area in which the impurity diffusion layer (individual electrode 21A) and the depletion layer 25 are not formed.

The present invention is not limited to the specifically disclosed embodiments, and variations and modifications may be made without departing from the present invention.

The present application is based on Japanese priority application No. 10-184551 filed on Jun. 30, 1998, the entire contents of which are hereby incorporated by reference.

What is claimed is:

1. An inkjet head ejecting a droplet of ink by an electrostatic force generated between a first electrode and a second electrode, said inkjet head comprising:

a first body member having a plurality of vibration plates each of which corresponds to said first electrode;

a second body member having a plurality of individual electrodes each of which corresponds to said second electrode;

spacer portions provided to at least one of said first body member and said second body member so that said first body member and said second body member are bonded to each other with said spacer portions therebetween so as to define a space providing a gap between each of said vibration plates and a respective one of said individual electrodes; and vent passages defined by said spacer portions, said vent passages connecting each of said spaces to atmosphere.

2. The inkjet head as claimed in claim 1, wherein said vent passages are grooves formed on said spacer portions.

3. The inkjet head as claimed in claim 1, wherein a size of a cross section of each of said vent passages is smaller than about two thirds of an effective gap between each of said vibration plates and the respective one of said individual electrodes.

4. The inkjet head as claimed in claim 1, wherein each of said first body member and said second body member is made of one of a metal material and a semiconductor material, and said spacer portions are made of a metal material which is eutectic with the material of at least one of said first body member and said second body member.

5. The inkjet head as claimed in claim 4, wherein each of said spacer portions has a layered structure comprising a plurality of metal layers so that one of said metal layers contacting said first body member is made of a metal material eutectic with the material of said first body member and another one of said metal layers contacting said second body member is made of a metal material eutectic with the material of said second body member.

6. The inkjet head as claimed in claim 1, wherein each of said first body member and said second body member is formed of a silicon substrate, and each of said spacer portions is formed by an oxidation layer of the silicon substrate.

7. The inkjet head as claimed in claim 1, wherein each of said individual electrodes is an impurity diffusion layer formed in said second body member.

8. An inkjet head ejecting a droplet of ink by an electrostatic force generated between a first electrode and a second electrode, said inkjet head comprising:

a first body member having a plurality of vibration plates each of which corresponds to said first electrode;

a second body member having a plurality of individual electrodes each of which corresponds to said second electrode; and spacer portions provided to at least one of said first body member and said second body member so that said first body member and said second body member are bonded to each other with said spacer portions therebetween so as to define a space providing a gap between each of said vibration plates and a respective one of said individual electrodes, wherein each edge of said spacer portions contacting said first body member is depressed so that said spacer portions are bonded to said first body member without edges being in contact with said first body member.

9. The inkjet apparatus as claimed in claim 8, wherein vent passages are defined by said spacer portions so that said vent passages connect each of said spaces to atmosphere.

10. An inkjet head ejecting a droplet of ink by an electrostatic force, said inkjet head comprising:

a vibration plate defining a first electrode;

an individual electrode defining a second electrode, said individual electrode being located opposite to said vibration plate so as to generate the electrostatic force; and protrusion patterns formed on at least one of said vibration plate and said individual electrode so that said protrusion patterns are positioned between said vibration plate and said individual electrode.

11. A method for manufacturing an inkjet head ejecting a droplet of ink by an electrostatic force generated between a first electrode and a second electrode, said inkjet head comprising:

a first body member having a plurality of vibration plates each of which corresponds to said first electrode;

a second body member having a plurality of individual electrodes each of which corresponds to said second electrode, each of said individual electrodes being covered by a protective film; and spacer portions provided to at least one of said first body member and said second body member so that said first body member and said second body member are bonded to each other with said spacer portions therebetween so as to define a space providing a gap between each of said vibration plates and a respective one of said individual electrodes, wherein each edge of said spacer portions contacting said first body member is depressed so that said spacer portions are bonded to said first body member without edges being in contact with said first body member, the method comprising the steps of:

forming an oxidation layer on said first body member formed by a silicon substrate;

removing portions of said oxidation layer so that said spacer portions are formed by the remaining portions of said oxidation layer;

removing edges of said spacer portions so as to form said depressions;

forming an impurity diffusion layer in areas of said first body member exposed by the removal of said oxidation layer; and forming an oxidation layer on each of said individual electrodes so as to form said protective film.

12. The method as claimed in claim 11, wherein vent passages are formed in said spacer portions so that said vent passages connect each of said spaces to atmosphere, and said vent passages are formed in the step of removing edges of said spacer portions.

13. A method for manufacturing an inkjet head ejecting a droplet of ink by an electrostatic force, said inkjet head comprising:

a vibration plate forming a first electrode;

an individual electrode forming a second electrode, said individual electrode being located opposite to said vibration plate so as to generate the electrostatic force; and protrusion patterns formed on said individual electrode so that said protrusion patterns are positioned between said vibration plate and said individual electrode, the method comprising the steps of:

forming an oxidation layer on a silicon substrate;

removing portions of said oxidation layer so that spacer portions are formed by the remaining portions of said oxidation layer;

forming an impurity diffusion layer in areas of said silicon substrate exposed by the removal of said oxidation layer, said impurity diffusion layer defining said individual electrode;

forming an oxidation layer on said individual electrode;

removing edges of said spacer portions so as to form depressions, and simultaneously removing portions of said oxidation layer on said individual electrode so as to form said protrusion patterns;

forming a protective film on said individual electrode.

14. An inkjet head ejecting a droplet of ink by an electrostatic force generated between a first electrode and a second electrode, said inkjet head comprising:

a first body member having a plurality of vibration plates each of which corresponds to said first electrode;

a second body member having a plurality of individual electrodes each of which corresponds to said second electrode; and spacer portions provided to at least one of said first body member and said second body member so that said first body member and said second body member are bonded to each other with said spacer portions therebetween so as to define a space providing a gap between each of said vibration plates and a respective one of said individual electrodes, wherein each of said first body member and said second body member is made of a silicon substrate, and each of said spacer portions is formed by an oxidation layer of the silicon substrate, and wherein each of said individual electrodes is defined by an impurity diffusion layer formed in said second body member and said impurity diffusion layer is offset from said spacer portions.

* * * * *